US009196986B2

(12) United States Patent
Tanaka et al.

(10) Patent No.: US 9,196,986 B2
(45) Date of Patent: Nov. 24, 2015

(54) CONTACT, CONNECTOR, AND METHOD OF PRODUCING CONNECTOR

(71) Applicant: FUJITSU COMPONENT LIMITED, Tokyo (JP)

(72) Inventors: Tetsugaku Tanaka, Tokyo (JP); Yasuyuki Miki, Tokyo (JP); Koki Sato, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/558,819

(22) Filed: Dec. 3, 2014

(65) Prior Publication Data

US 2015/0162685 A1 Jun. 11, 2015

(30) Foreign Application Priority Data

Dec. 9, 2013 (JP) ..... 2013-254441

(51) Int. Cl.

| | |
|---|---|
| ***H01R 24/00*** | (2011.01) |
| ***H01R 12/73*** | (2011.01) |
| ***H01R 12/58*** | (2011.01) |
| *H01R 12/71* | (2011.01) |
| *H01R 13/24* | (2006.01) |

(52) U.S. Cl.

CPC ..... *H01R 12/737* (2013.01); *H01R 12/585* (2013.01); *H01R 12/716* (2013.01); *H01R 13/2457* (2013.01)

(58) Field of Classification Search

CPC .. H01R 12/737; H01R 12/716; H01R 12/585; H01R 13/2457

USPC ..... 439/59, 62, 630, 637

See application file for complete search history.

(56) References Cited

U.S. PATENT DOCUMENTS

| | | | | |
|---|---|---|---|---|
| 7,303,419 | B1 * | 12/2007 | Ju | H01R 12/716 439/157 |
| 7,637,783 | B2 * | 12/2009 | Sasaoka | H01R 43/16 439/637 |
| 8,113,863 | B2 * | 2/2012 | Vrenna | H01R 12/721 439/327 |
| 8,597,056 | B2 * | 12/2013 | Blanchfield | H01R 12/721 439/630 |
| 8,672,713 | B2 | 3/2014 | Tajiri et al. | |
| 9,065,225 | B2 * | 6/2015 | Degner | H01R 12/721 |

FOREIGN PATENT DOCUMENTS

| | | |
|---|---|---|
| JP | 2012-221592 | 11/2012 |

* cited by examiner

*Primary Examiner* — Khiem Nguyen
(74) *Attorney, Agent, or Firm* — IPUSA, PLLC

(57) ABSTRACT

A contact of a connector includes a board contact part to be connected to a circuit board; a first contact part including an extension part that is connected to the board contact part and extends in an insertion direction in which a target object is inserted into the connector, a first bent part that extends from the extension part and is bent to one side, and a first contact point that is located closer to an end of the first contact part than the first bent part and contacts the target object; and a second contact part including a second bent part that is connected to the board contact part and is bent to the one side, and a second contact point that is located closer to an end of the second contact part than the second bent part and contacts the target object.

5 Claims, 11 Drawing Sheets

CONTACT, CONNECTOR, AND METHOD OF PRODUCING CONNECTOR

CROSS-REFERENCE TO RELATED APPLICATION

The present application is based upon and claims the benefit of priority of Japanese Patent Application No. 2013-254441, filed on Dec. 9, 2013, the entire contents of which are incorporated herein by reference.

BACKGROUND OF THE INVENTION

1. Field of the Invention

An aspect of this disclosure relates to a contact, a connector, and a method of producing the connector.

2. Description of the Related Art Japanese Laid-Open Patent Publication No. 2012-221592, for example, discloses a contact of a connector that connects a circuit board and a target object with each other. The contact includes a first terminal and a second terminal that are brought into contact with the target object. A contact point of the first terminal and a contact point of the second terminal are arranged in an insertion/removal direction in which the target object is inserted into or removed from the connector.

When the target object is inserted into the connector, the contact point of the first terminal first contacts a terminal of the target object and wipes off foreign matter such as dirt or dust on the surface of the terminal of the target object, and then the contact point of the second terminal contacts the terminal of the target object. This configuration makes it possible to maintain the reliability of connection between the connector and the target object.

However, because the contact of Japanese Laid-Open Patent Publication No. 2012-221592 is configured such that the second terminal extends linearly from a support part in the insertion/removal direction, the pressing force of the second terminal against the target object may become insufficient and the reliability of connection between the connector and the target object may be reduced.

SUMMARY OF THE INVENTION

In an aspect of this disclosure, there is provided a contact of a connector for connecting a target object to a circuit board. The contact includes a board contact part to be connected to the circuit board; a first contact part including an extension part that is connected to the board contact part and extends in an insertion direction in which the target object is inserted into the connector, a first bent part that extends from the extension part and is bent to one side, and a first contact point that is located closer to an end of the first contact part than the first bent part and comes into contact with the target object; and a second contact part including a second bent part that is connected to the board contact part and is bent to the one side, and a second contact point that is located closer to an end of the second contact part than the second bent part and comes into contact with the target object, the first contact point and the second contact point being arranged in the insertion direction.

DESCRIPTION OF EMBODIMENTS

Figure 1:
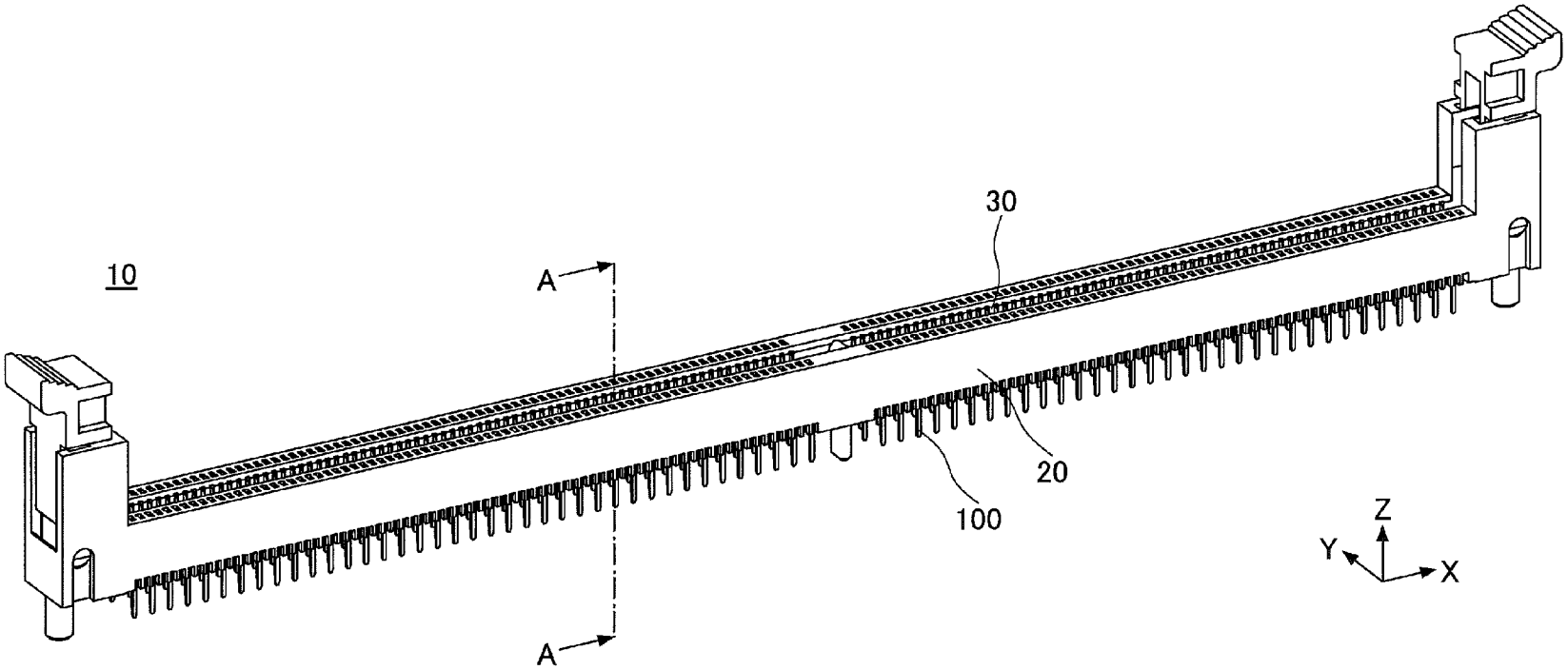
FIG. 1 is a perspective view of a connector according to a first embodiment.

Embodiments of the present invention are described below with reference to the accompanying drawings. The same reference number is assigned to the same components in the drawings, and repeated descriptions of those components may be omitted.

First Embodiment

FIG. 1 is a perspective view of a connector 10 according to a first embodiment. In the drawings, an X-direction indicates the length direction of the connector 10, a Y-direction indicates the width direction of the connector 10, and a Z-direction indicates the height direction of the connector 10.

The connector 10 includes a housing 20, a slot 30, and multiple contacts 100. For example, the connector 10 is mounted on a circuit board (which is hereafter referred to as a "circuit board A" for descriptive purposes) and connects a target object to the circuit board A. The connector 10 is, for example, a card edge connector. Examples of target objects to be inserted into the slot 30 of the connector 10 include a circuit board on which terminals are formed and a flexible printed circuit (FPC) board.

The housing 20 is made of, for example, an insulating resin, and the lower side of the housing 20 is fixed to the circuit board A. The slot 30 is formed in the housing 20. A target object is inserted into the slot 30 in the Z-direction. The contacts 100 are arranged in the housing 20 at regular intervals in the X-direction.

Figure 2:
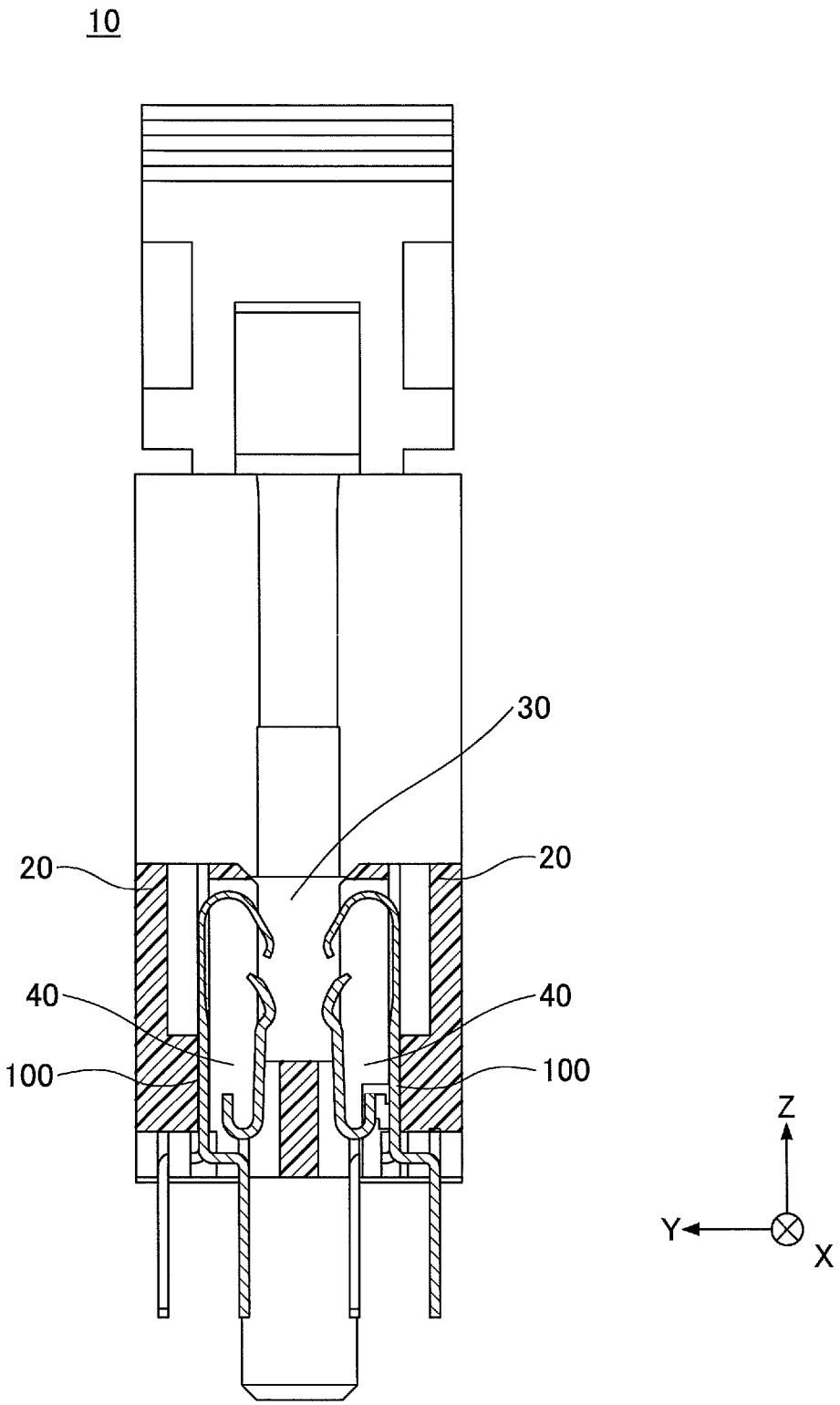
FIG. 2 is a cross-sectional view of a connector taken along line A-A of FIG. 1.

FIG. 2 is a cross-sectional view of the connector 10 taken along line A-A of FIG. 1.

As illustrated by FIG. 2, the contacts 100 are arranged in two rows that extend in the X-direction. The contacts 100 in one row face the corresponding contacts 100 in the other row in the Y-direction. The target object is inserted between the rows of the contacts 100 facing each other in the Y-direction. That is, the connector 10 is configured such that the contacts 100 come into contact with two sides of the target object. Also, as described later, each contact 100 includes two contact points that are arranged in the Z-direction and contact the target object.

The contacts 100 are formed, for example, by punching and bending a conductive metal plate material. The contacts 100 are pressed into insert holes 40 of the housing 100 from the lower side of the housing 20 in FIG. 2, and are thereby fixed to the housing 20. Each contact 100 includes contact points that are exposed in the slot and touch the target object, and a connecting part that protrudes downward from the insert hole 40 and is connected to the circuit board A. With this configuration, the contacts 100 connect the target object inserted into the connector 10 to the circuit board A.

Figure 3B:
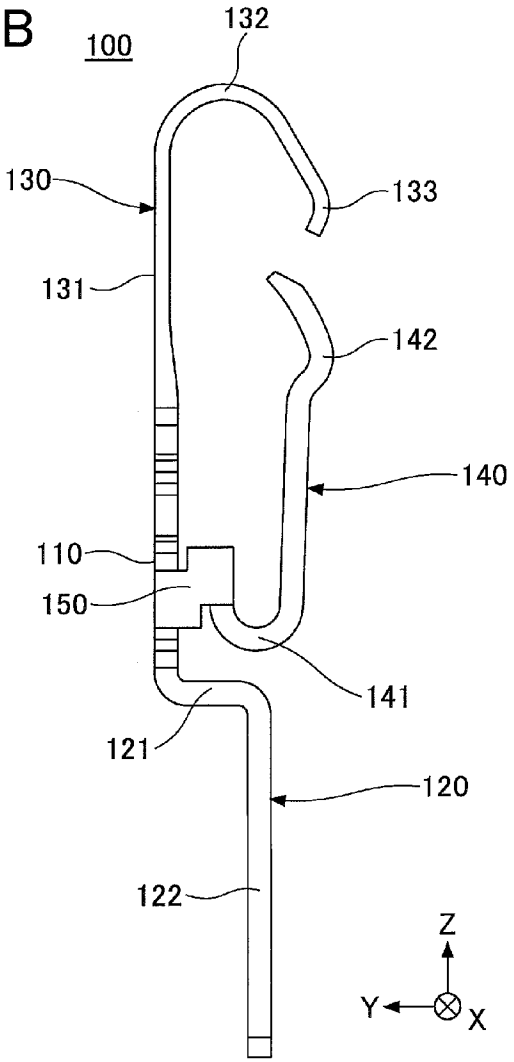
FIGS. 3A and 3B are drawings illustrating a contact according to the first embodiment.
Figure 3A:
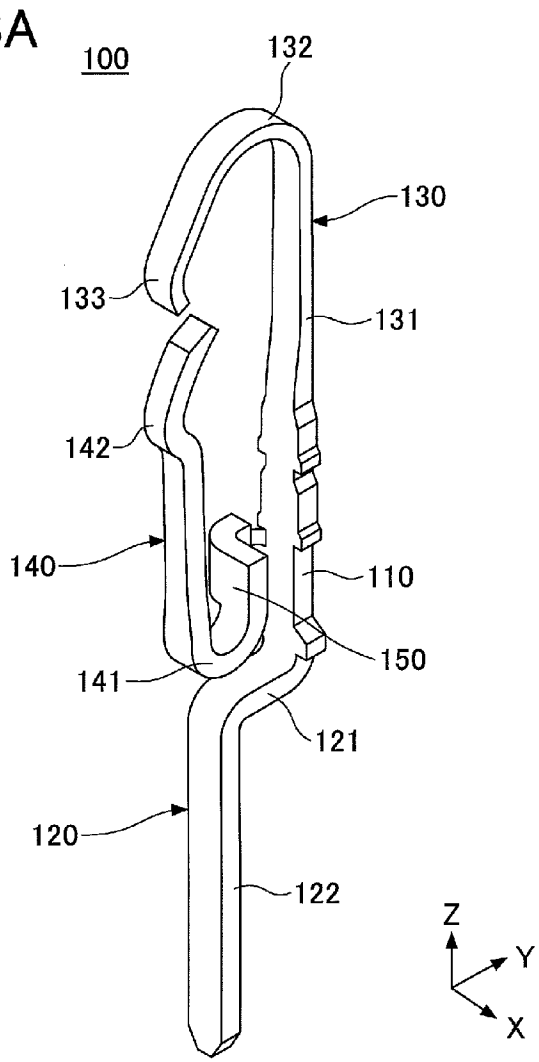

FIGS. 3A and 3B are drawings illustrating the contact 100 according to the first embodiment. FIG. 3A is a perspective view of the contact 100, and FIG. 3B is a side view of the contact 100.

As illustrated by FIGS. 3A and 3B, the contact 100 includes a fixed part 110, a board contact part 120, a first contact part 130, a second contact part 140, and a joining part 150. In the descriptions below, it is assumed that the board contact part 120 is on the lower side in the Z-direction, and the first contact part 130 is on the upper side in the Z-direction.

When the contact 100 is pressed into the insert hole 40 of the housing 20, the fixed part 110 comes into contact with the inner surface of the insert hole 40 and is fixed to the housing 20. The fixed part 110 connects the board contact part 120 and the first contact part 130 in a direction (Z-direction) in which the target object is inserted into the connector 10.

The board contact part 120 includes a step part 121 and a connecting part 122. In a state where the contact 100 is fixed to the housing 20, the step part 121 extends in the Y-direction toward a "target object side" (i.e., the right side in FIG. 3B) on which the target object inserted into the slot 30 is located. The connecting part 122 extends from the step part 121 in the downward Z-direction. The contact 100 is a DIP (dual in-line package) type. As illustrated in FIG. 2, a lower part of the connecting part 122 is exposed and protrudes from the insert hole 40 of the housing 20. For example, the connecting part 122 is inserted into a through hole formed in the circuit board A and soldered onto the circuit board A.

Depending on the arrangement of the contacts 100 in the connector 10, the step part 121 may be formed to extend from the fixed part 110 toward a side (the left side in FIG. 3B) that is opposite to the target object side.

The first contact part 130 is connected to the fixed part 110, and includes an extension part 131, a first bent part 132, and a first contact point 133. The extension part 131 extends from the fixed part 110 in the upward Z-direction. The first bent part 132 is formed by bending the extension part 131 toward the target object side and then downward. The first contact point 133 is located closer to the end of the first contact part 130 than the first bent part 132. The outer surface of the first contact point 133 touches an electric contact of the target object. The first contact point 133 is formed in a curved shape that curves toward the target object side so as not to damage the target object.

The first contact part 130 has a structure like a flat spring. When the target object is inserted into the connector 10, the first contact point 133 is pressed by the target object toward the extension part 131, and the first bent part 132 is elastically deformed. A restoring force is generated in the elastically-deformed first bent part 132, and the restoring force causes the first contact point 133 to move toward the target object side. Accordingly, the elasticity of the first bent part 132 of the first contact part 130 makes it possible to improve the reliability of connection between the first contact point 133 and the target object.

One end of the second contact part 140 is joined via the joining part 150 to the fixed part 110. The second contact part 140 includes a second bent part 141 and a second contact point 142.

The joining part 150 is joined to the fixed part 110, and joins the fixed part 110 and the second contact part 140. A part of the joining part 150 extending in the Y-direction from the fixed part 110 is bent in the X-direction.

The second bent part 141 of the second contact part 140 is formed by bending a part of the second contact 140, which extends downward from the joining part 150, in the upward Z-direction. The second contact point 142 is located closer to an end of the second contact part 140 than the second bent part 141. The second contact point 142 and the first contact point 133 of the first contact part 130 are arranged in the Z-direction, and come into contact with the target object. The second contact point 142 is formed in a curved shape that curves toward the target object side so as not to damage the target object.

The second contact part 140 has a structure like a flat spring. When the target object is inserted into the connector 10, the second contact point 142 is pressed by the target object toward the extension part 131 of the first contact part 130, and the second bent part 141 is elastically deformed. A restoring force is generated in the elastically-deformed second bent part 141, and the restoring force causes the second contact point 142 to move toward the target object side. Accordingly, the elasticity of the second bent part 141 of the second contact part 140 makes it possible to improve the reliability of connection between the second contact point 142 and the target object.

When the target object is inserted into the slot 30 of the connector 10, the first contact point 133 located higher than the second contact point 142 in the Z-direction contacts the target object first, and rubs off foreign matter such as dirt or dust on a surface of an electric contact of the target object. Then, the second contact point 142 located lower than the first contact point 133 in the Z-direction contacts the target object. Thus, the contact 100 is configured such that the second contact point 142 contacts the target object after the target object is wiped by the first contact point 133. This configuration makes it possible to improve the reliability of connection between the second contact point 142 and the target object.

Also, the first contact part 130 and the second contact part 140 extend in opposite directions from different parts of the connector 100, and can be elastically deformed independently of each other. With this configuration, even when the first contact part 130 is pressed by the target object and elastically deformed, the second contact part 140 is not deformed together with the first contact part 130, and the state of contact between the second contact part 140 and the target object does not change. Similarly, the first contact part 130 is not influenced by the elastic deformation of the second contact part 140. Thus, the contact 100 of the present embodiment is configured such that the first contact part 130 and the second contact part 140 can contact the target object without being influenced by the elastic deformation of each other. Accordingly, this configuration makes it possible to further improve the reliability of connection between the contact 100 and the target object.

Next, an exemplary method of producing the contacts 100 and the connector 10 is described.

First, by punching a conductive metal plate material, intermediate materials of the contacts 100 are formed. Each of the intermediate materials includes the fixed part 110, the board contact part 120, the first contact part 130, the second contact part 140, and the joining part 150.

Figure 4:
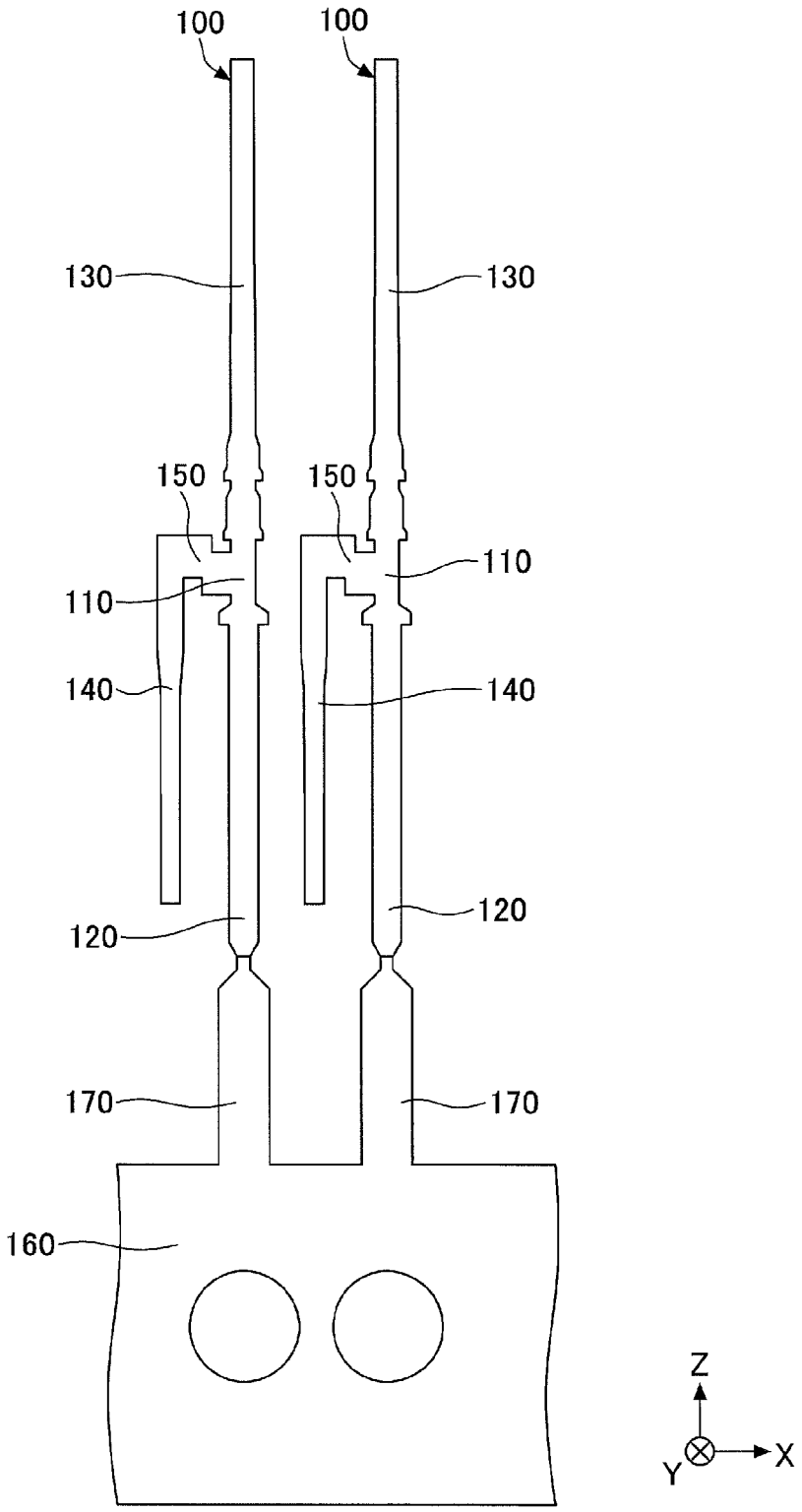
FIG. 4 is a drawing illustrating intermediate materials of contacts formed by a punching process.

FIG. 4 is a drawing illustrating intermediate materials of the contacts 100 formed by a punching process.

As illustrated by FIG. 4, a carrier part 160 and multiple intermediate materials of the contacts 100 connected to the carrier part 160 are formed by punching one plate material. The intermediate materials of the contacts 100 and the carrier part 160 may also be formed by a method other than punching. In the descriptions below, the intermediate materials of the contacts 100 may be simply referred to as the "contacts 100" for brevity.

As illustrated by FIG. 4, each of the contacts 100 after the punching process includes the fixed part 110, the board contact part 120, the first contact part 130, the second contact part 140, and the joining part 150.

The board contact part 120 and the first contact part 130 are connected to each other via the fixed part 110, and extend in the Z-direction. One end of the second contact 140 is connected to the joining part 150 that extends in the X-direction from the fixed part 110. The second contact part 140 extends in the Z-direction to the side of the board contact part 120.

Multiple intermediate materials of the contacts 100 are formed at regular intervals in one plate material. The interval (or distance) in the X-direction between the intermediate materials of the contacts 100 is preferably set as small as possible to form as many contacts 100 as possible from one plate material and thereby reduce the material cost.

The carrier part 160 includes multiple holding parts 170 that protrude toward the contacts 100 and are connected to ends of the board contact parts 120 to hold the contacts 100.

A neck part with a small width in the X-direction is formed between the board contact part 120 of each contact 100 and the corresponding holding part 170 of the carrier part 160 to make it easier to separate the carrier part 160 from the contacts 100 at a later step. Instead of the neck part, a cut may be formed between the board contact part 120 and the holding part 170.

Next, a bending process is performed on each of the contacts 100 with the contacts 100 being connected to and held by the carrier part 160.

During the bending process, the joining part 150 is bent to one side. Next, the first contact part 130 is bent to one side to form the first bent part 132 and the first contact point 133. Next, the second contact part 140 is bent to one side to form the second bent part 141 and the second contact point 142. Then, the board contact part 120 is bent to form the step part 121. The above steps in the bending process may also be performed in a different order.

Figure 5:
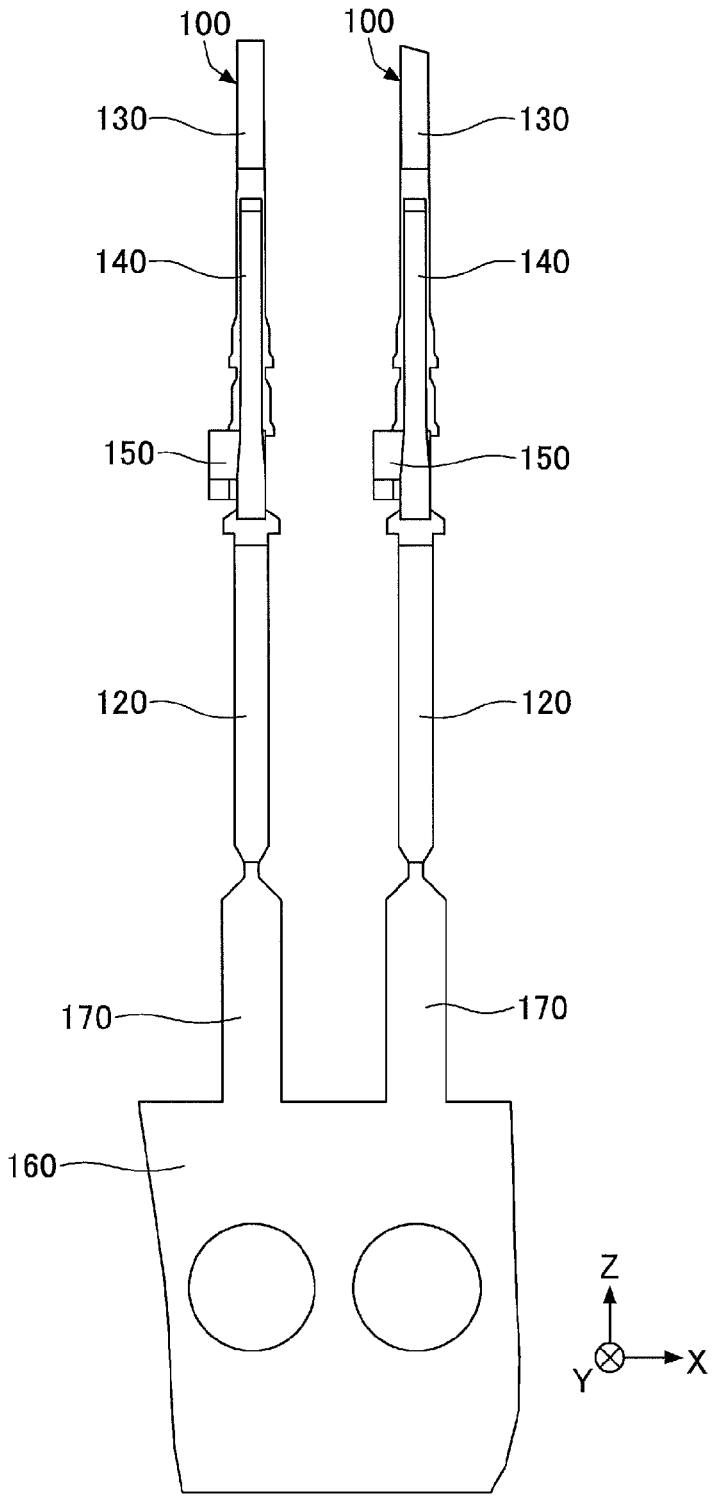
FIG. 5 is a drawing illustrating contacts after a bending process.

FIG. 5 is a drawing illustrating the contacts 100 and the carrier part 160 after the bending process.

As illustrated by FIG. 5, in each of the contacts 100 after the bending process, the board contact part 120, the first contact part 130, and the second contact part 140 are on the same line extending in the Z-direction when seen from the Y-direction.

The interval (or distance) in the X-direction between the contacts 100 is set at an integral multiple of the interval (or distance) in the X-direction between the insert holes 40 of the housing 20. The contacts 100, while being connected to the carrier part 160, are inserted at substantially the same time into the corresponding insert holes 40 of the housing 20 with the first contact parts 130 first. After the contacts 100 connected to the carrier 160 are inserted into the insert holes 40 of the housing 40, the holding parts 170 of the carrier 160 are cut off from the board contact parts 120 to complete the process of attaching the contacts 100 to the housing 20.

Thus, according to the present embodiment, the multiple contacts 100 connected to the carrier part 160 are inserted at once into the housing. Compared with a method where contacts are inserted one by one into a housing of a connector, this method makes it possible to greatly reduce the workload of producing a connector and improve productivity.

Figure 6:
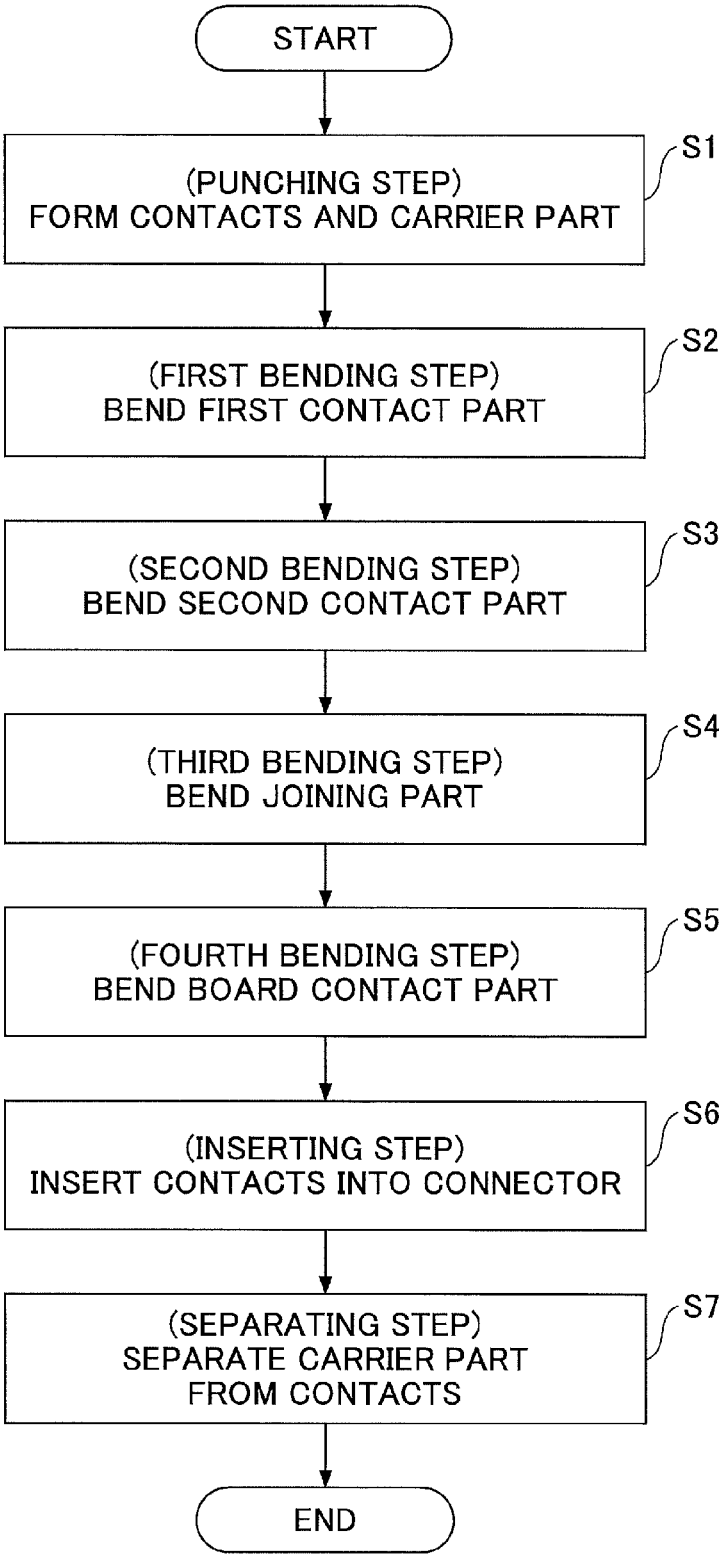
FIG. 6 is a flowchart illustrating a method of producing a connector according to the first embodiment.

FIG. 6 is a flowchart illustrating a method of producing the connector 10 according to the first embodiment.

At step S1 (punching step), multiple contacts 100 (or intermediate materials of the contacts 100) and the carrier part 160 connected to the contacts 100 are formed by punching a plate material.

At step S2 (first bending step), the first contact part 130 of each of the contacts 100 is bent to form the first bent part 132 and the first contact point 133. At step S3 (second bending step), the second contact part 140 of each of the contacts 100 is bent to form the second bent part 141 and the second contact point 142. At step S4 (third bending step), the joining part 150 is bent. At step S5 (fourth bending step), the board contact part 120 is bent to form the step part 121. The order of the first through fourth bending steps may be changed.

At step S6 (inserting step), the contacts 100 connected to the carrier 160 are inserted at substantially the same time into the insert holes 40 of the housing 20. At step S7 (separating step), the carrier part 160 is cut off from the contacts 100 to complete the process of attaching the contacts 100 to the housing 20.

As described above, the first embodiment makes it possible to improve the reliability of connection between the contacts 100 and the target object. Also, the first embodiment makes it possible to reduce the workload of producing the connector 10 and greatly improve productivity.

The board contact part 120 is not limited to a DIP (dual in-line package) type. For example, the board contact part 120 may be an SMT (surface mount) type or a press-fit type.

Figure 7B:
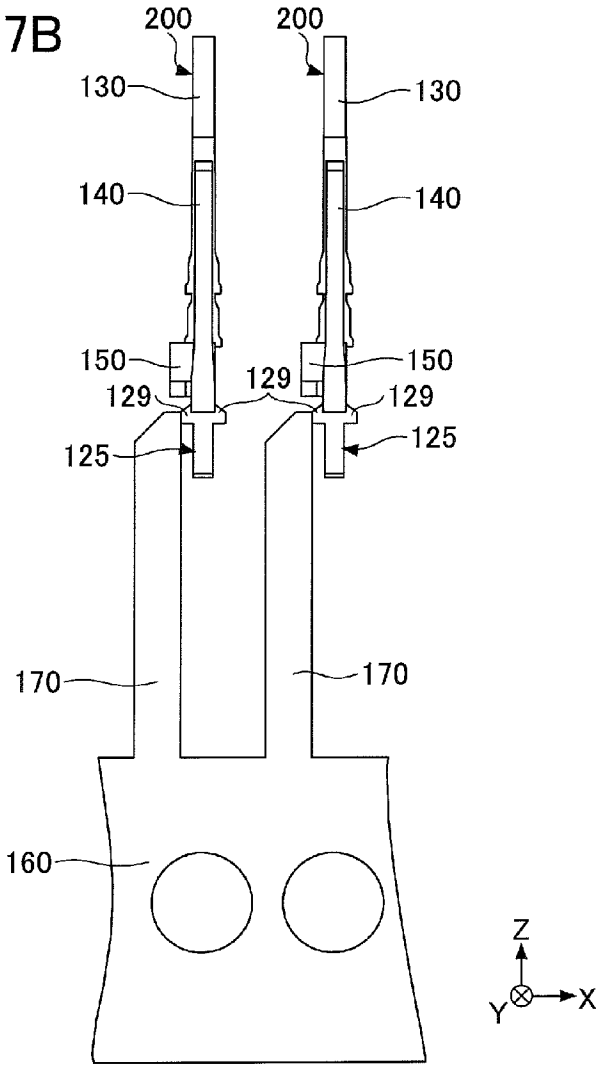
FIGS. 7A and 7B are drawings illustrating a contact according to a variation of the first embodiment.
Figure 7A:
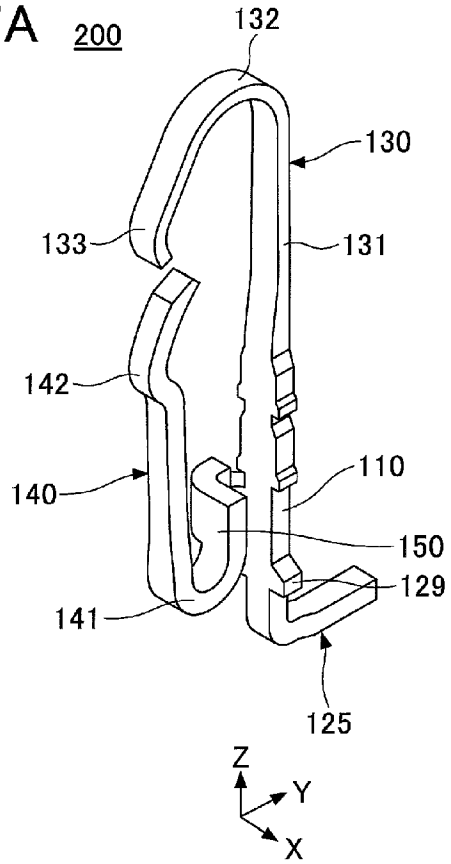

FIGS. 7A and 7B are drawings illustrating a contact 200 including an SMT-type board contact part 125. FIG. 7A is a perspective view of the contact 200. FIG. 7B is a drawing illustrating multiple contacts 200 that are in a state after the punching and bending processes and connected to the carrier part 160.

As illustrated by FIG. 7A, a lower-end part of the board contact part 125 of the contact 200 is bent in the Y-direction. The board contact part 125 is connected to the circuit board A by soldering the lower-end part bent in the Y-direction to a terminal of the circuit board A.

Also, as illustrated by FIG. 7B, the contact 200 includes a protruding part 129 protruding from the board contact part 125 in the X-direction. The protruding part 129 is connected to the holding part 170, and the contact 200 is thereby connected to the carrier part 160.

Figure 8B:
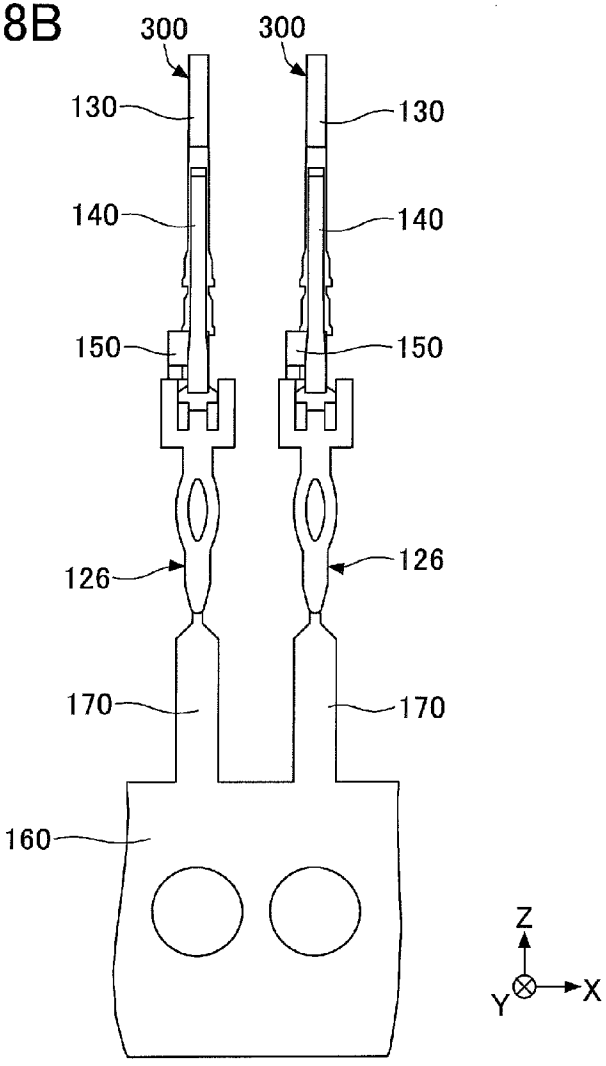
FIGS. 8A and 8B are drawings illustrating a contact according to a variation of the first embodiment.
Figure 8A:
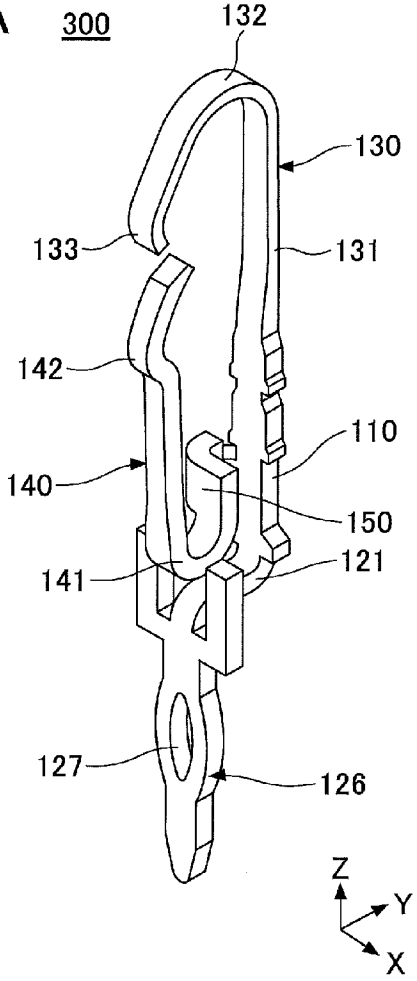

FIGS. 8A and 8B are drawings illustrating a contact 300 including a press-fit type board contact part 126. FIG. 8A is a perspective view of the contact 300. FIG. 8B is a drawing illustrating multiple contacts 300 that are in a state after the punching and bending processes and connected to the carrier part 160.

As illustrated by FIG. 8A, the board contact part 126 extends in the downward Z-direction from the step part 121 that extends in the Y-direction from the fixed part 110. A hole 127 is formed in the board contact part 126. When the board contact part 126 is inserted into a through hole formed in the circuit board A, the hole 127 allows the board contact part 127 to contract, and the board contact part 127 is fixed to the circuit board A by friction between the board contact part 127 and an inner surface of the through hole. The press-fit type board contact part 126 can be fixed to the circuit board A without using solder. Accordingly, using the press-fit type board contact part 126 makes it possibly to simplify a production process and reduce effects on the environment.

Also, as illustrated by FIG. 8B, the lower end of the board contact part 126 is connected to the holding part 170, and the contact 300 is thereby connected to the carrier part 160.

Second Embodiment

Next, a second embodiment is described. In the second embodiment, descriptions of components that are the same as the components described in the first embodiment are omitted.

A contact 400 of the second embodiment is different from the contacts 100 through 300 of the first embodiment in that the first contact part 130 extends from the joining part 150.

Figure 9B:
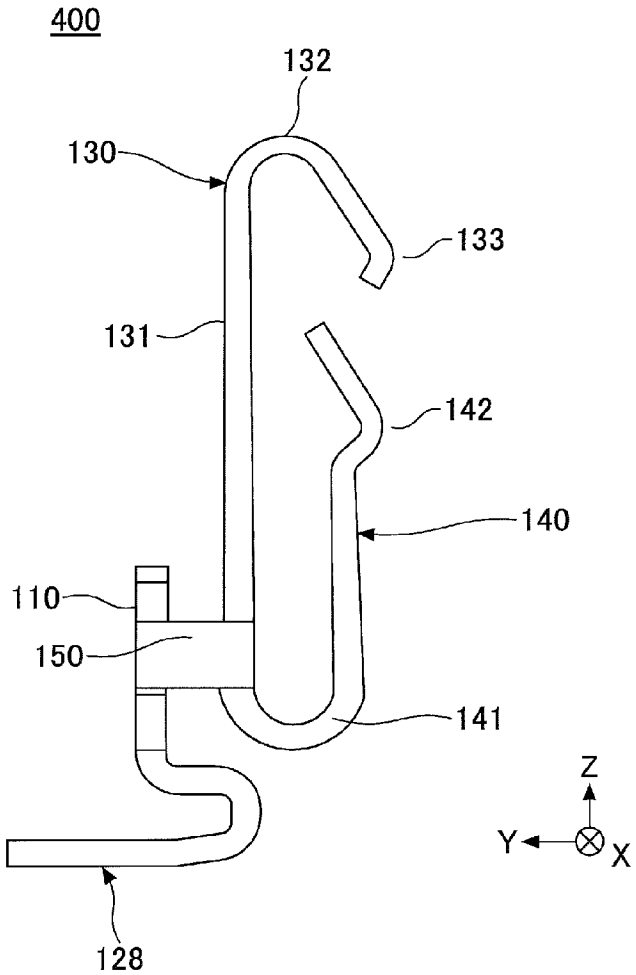
FIGS. 9A and 9B are drawings illustrating a contact according to a second embodiment.
Figure 9A:
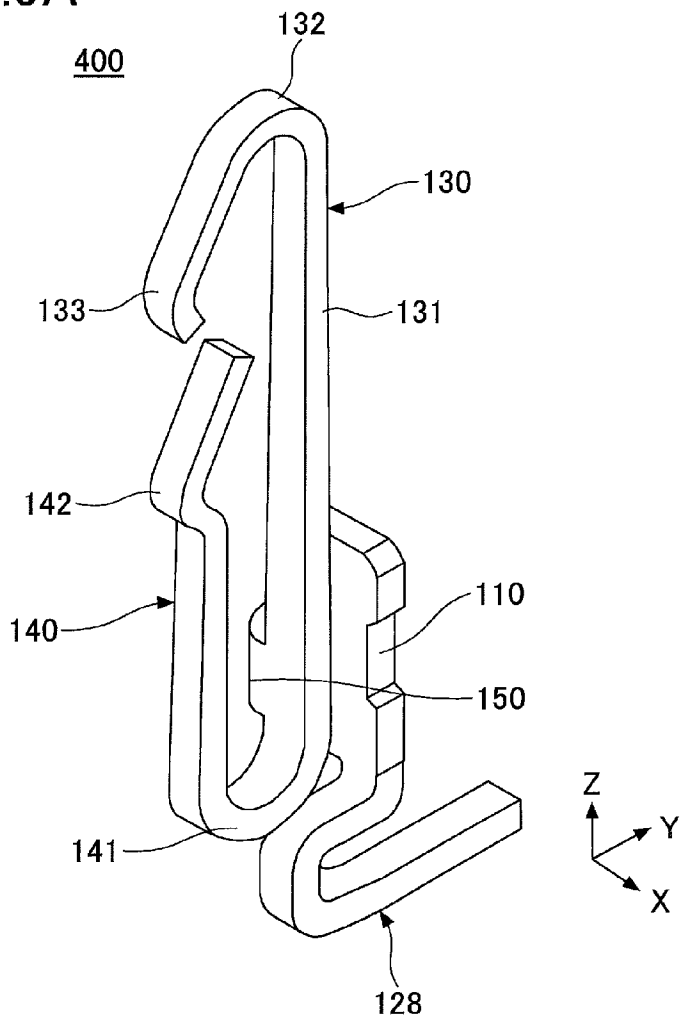

FIGS. 9A and 9B are drawings illustrating the contact 400 according to the second embodiment. FIG. 9A is a perspective view of the contact 400, and FIG. 3B is a side view of the contact 400.

As illustrated by FIGS. 9A and 9B, the extension part 131 of the first contact part 130 of the contact 400 extends in the upward Z-direction from the joining part 150. A board contact part 128 of the contact 400 of FIGS. 9A and 9B is the SMT type. However, the board contact part 128 may instead be the DIP type or the press-fit type.

Even with the configuration where the first contact part 130 extends from the joining part 150, similarly to the contact 100 of the first embodiment, the first contact part 130 and the second contact part 140 can be elastically deformed independently of each other. Thus, the contact 400 of the second embodiment is configured such that the first contact part 130 and the second contact part 140 can contact the target object without being influenced by the elastic deformation of each other. Accordingly, this configuration makes it possible to improve the reliability of connection between the contact 400 and the target object. Also, the contact 400 is configured such that the second contact point 142 contacts the target object after the target object is wiped by the first contact point 133. This configuration, together with the elasticity of the first contact part 130 and the second contact part 140, makes it possible to improve the reliability of connection between the contact 400 and the target object.

Third Embodiment

Next, a third embodiment is described. In the third embodiment, descriptions of components that are the same as the components described in the first and second embodiments are omitted.

A contact 500 of the third embodiment is different from the contacts 100 through 300 of the first embodiment in that the second contact part 140 extends in the upward Z-direction from the joining part 150 and is also inclined toward the target object side.

Figure 10B:
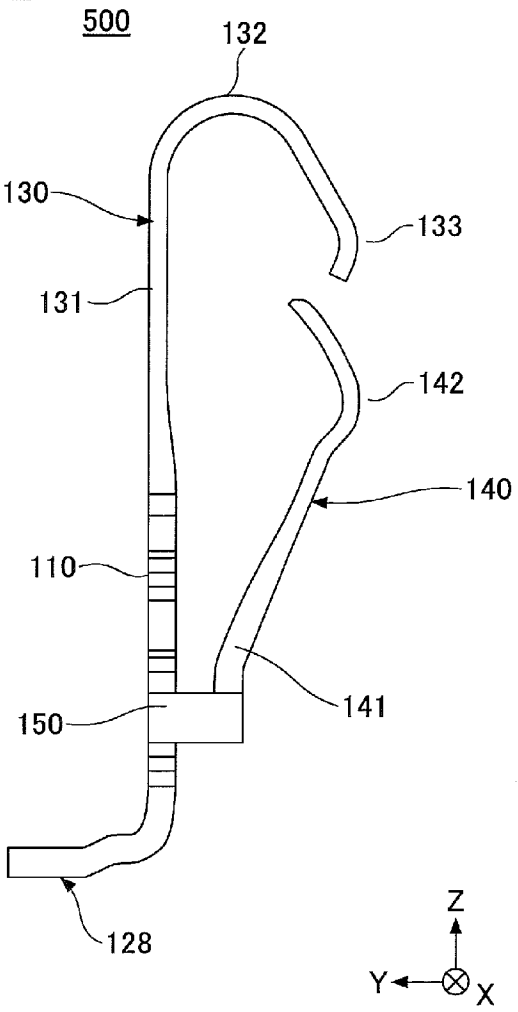
FIGS. 10A and 10B are drawings illustrating a contact according to a third embodiment.
Figure 10A:
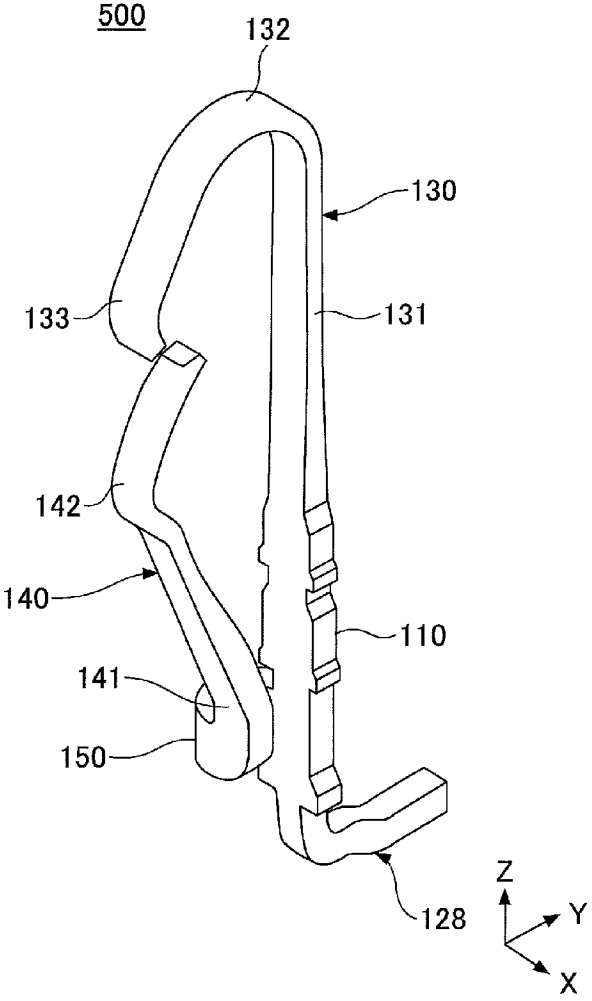

FIGS. 10A and 10B are drawings illustrating the contact 500 according to the third embodiment. FIG. 10A is a perspective view of the contact 500, and FIG. 10B is a side view of the contact 500.

As illustrated by FIGS. 10A and 10B, the second bent part 141 of the second contact part 140 of the contact 500 is bent toward the target object side (the right side in FIG. 10B) and is formed near the joining part 150. The second contact part 140 extends in the upward Z-direction, and is also inclined by the second bent part 141 toward the target object side. The board contact part 128 of the contact 500 of FIGS. 10A and 10B is the SMT type. However, the board contact part 128 may instead be the DIP type or the press-fit type.

Thus, the contact 500 of the third embodiment is configured such that the second contact part 140 extends in the upward Z-direction from the joining part 150 and is also inclined toward the target object side. Also, the first contact part 130 and the second contact part 140 can be elastically deformed independently of each other. With this configuration, the first contact part 130 and the second contact part 140 can contact the target object without being influenced by the elastic deformation of each other. Accordingly, this configuration makes it possible to improve the reliability of connection between the contact 500 and the target object. Also, the contact 500 is configured such that the second contact point 142 contacts the target object after the target object is wiped by the first contact point 133. This configuration, together with the elasticity of the first contact part 130 and the second contact part 140, makes it possible to improve the reliability of connection between the contact 500 and the target object.

Fourth Embodiment

Next, a fourth embodiment is described. In the fourth embodiment, descriptions of components that are the same as the components described in the first through third embodiments are omitted.

Figure 11B:
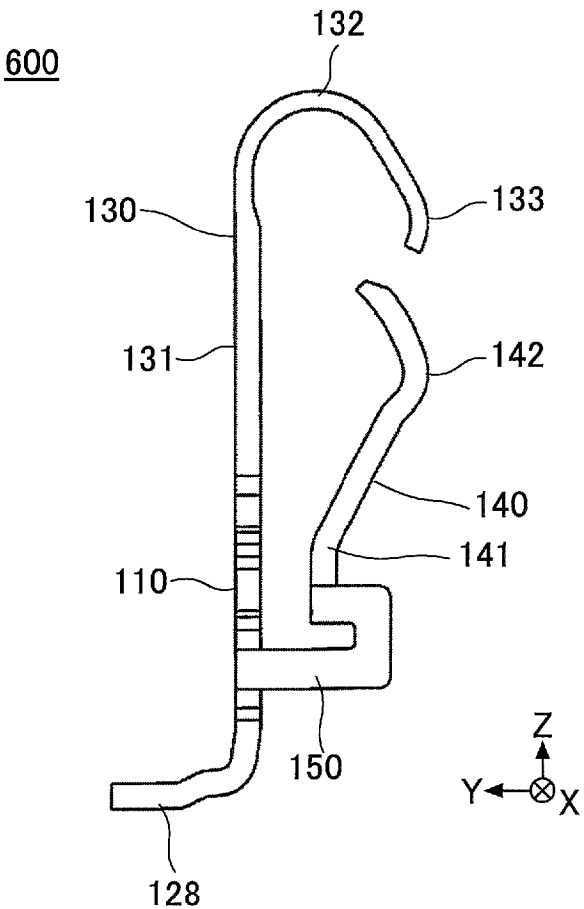
FIGS. 11A and 11B are drawings illustrating a contact according to a fourth embodiment.
Figure 11A:
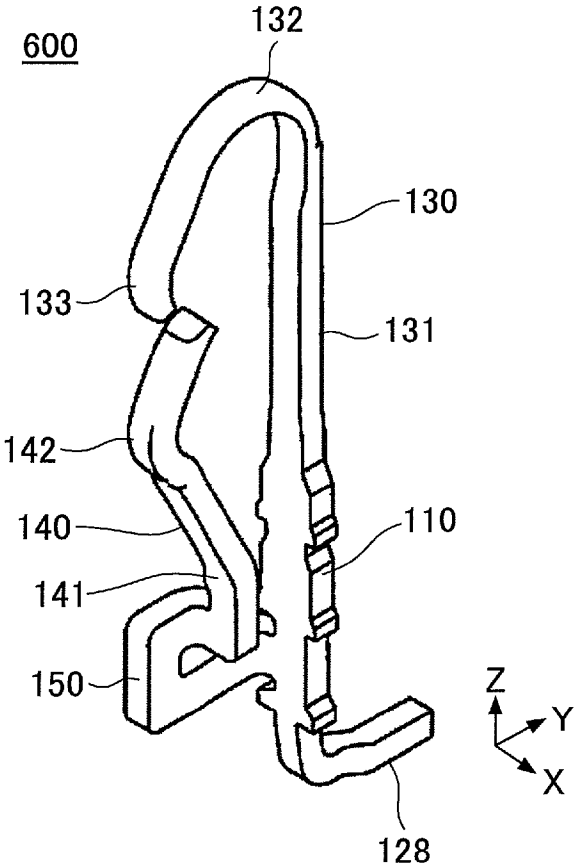

FIGS. 11A and 11B are drawings illustrating a contact 600 according to the fourth embodiment. FIG. 11A is a perspective view of the contact 600, and FIG. 11B is a side view of the contact 600.

As illustrated by FIGS. 11A and 11B, the joining part 150 of the contact 600 has a substantially U-shape, and one end of the joining part 150 is connected to the fixed part 110. The joining part 150 is bent in the Y-direction toward the target object side (the right side in FIG. 11B). Another end of the joining part 150 is connected to the second contact part 140.

The second bent part 141 of the second contact part 140 is bent toward the target object side and is formed near the joining part 150. The second contact part 140 extends in the upward Z-direction, and is also inclined by the second bent part 141 toward the target object side. The board contact part 128 of the contact 600 of FIGS. 11A and 11B is the SMT type. However, the board contact part 128 may instead be the DIP type or the press-fit type.

Thus, the contact 600 of the fourth embodiment is configured such that the second contact part 140 extends from the joining part 150 extending from the fixed part 110 and having a substantially U-shape, and is also inclined toward the target object side. With this configuration, the first contact part 130 and the second contact part 140 can be elastically deformed independently of each other, and therefore can contact the target object without being influenced by the elastic deformation of each other. Accordingly, this configuration makes it possible to improve the reliability of connection between the contact 600 and the target object. Also, the contact 600 is configured such that the second contact point 142 contacts the target object after the target object is wiped by the first contact point 133. This configuration, together with the elasticity of the first contact part 130 and the second contact part 140, makes it possible to improve the reliability of connection between the contact 600 and the target object.

An aspect of this disclosure provides a contact that can improve the reliability of connection between a connector and a target object.

A contact, a connector, and a method of producing the connector according to the embodiments of the present invention are described above. However, the present invention is not limited to the specifically disclosed embodiments, and variations and modifications may be made without departing from the scope of the present invention.

What is claimed is:

1. A contact of a connector for connecting a target object to a circuit board, the contact comprising:

a board contact part to be connected to the circuit board;

a first contact part including an extension part that is connected to the board contact part and extends in an insertion direction in which the target object is inserted into the connector, a first bent part that extends from the extension part and is bent to one side, and a first contact point that is located closer to an end of the first contact part than the first bent part and comes into contact with the target object; and a second contact part including a second bent part that is connected to the board contact part and is bent to the one side, and a second contact point that is located closer to an end of the second contact part than the second bent part and comes into contact with the target object, the first contact point and the second contact point being arranged in the insertion direction.

2. The contact as claimed in claim 1, further comprising:

a fixed part for fixing the contact to a housing of the connector; and a joining part that extends from the fixed part in a direction substantially orthogonal to the insertion direction, one end of the joining part being connected to the fixed part and another end of the joining part being connected to the second contact part.

3. The contact as claimed in claim 1, further comprising:

a fixed part for fixing the contact to a housing of the connector; and a joining part that extends from the fixed part in a direction substantially orthogonal to the insertion direction, wherein one end of the joining part is connected to the fixed part, and another end of the joining part connects the first contact part and the second contact part to each other in the insertion direction.

4. A connector, comprising:

a housing; and contacts provided in the housing for connecting a target object to be inserted into the connector and a circuit board on which the connector is to be mounted, wherein each of the contacts includes a board contact to be connected to the circuit board;

a first contact that is connected to the board contact and includes a first bent part that is bent toward one side, and a first contact point that is positioned between an end of the first contact and the first bent part and comes into contact with the target object; and a second contact that is connected to the board contact and includes a second bent part that is bent toward the one side, and a second contact point that is positioned between an end of the second contact and the second bent part and comes into contact with the target object, the first contact point and the second contact point being arranged in the insertion direction.

5. A method of producing a connector for connecting a target object to a circuit board, the method comprising:

punching a plate material to form a plurality of contacts each of which includes a board contact part to be connected to the circuit board, a first contact part connected to the board contact part and extends in an insertion direction in which the target object is inserted into the connector, and a second contact part connected to the board contact part, and a carrier part connected to the board contact part of each of the contacts;

bending each first contact part to form a first bent part that extends from an extension part connected to the board contact part and is bent to one side, and a first contact point that is located closer to an end of the first contact part than the first bent part and comes into contact with the target object;

bending each second contact part to form a second bent part that is connected to the board contact part and is bent to the one side, and a second contact point that is located closer to an end of the second contact part than the second bent part and comes into contact with the target object, the first contact point and the second contact point being arranged in the insertion direction;

inserting each of the contacts connected to the carrier part into an insert hole formed in a housing of the connector; and separating the carrier part from the contacts.

* * * * *